US009502839B2

(12) United States Patent
Tsai et al.

(10) Patent No.: US 9,502,839 B2
(45) Date of Patent: Nov. 22, 2016

(54) ELECTRICAL RECEPTACLE CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW); Chung-Fu Liao, New Taipei (TW); Ya-Fen Kao, New Taipei (TW); Rui Su, New Taipei (TW); Lin-Feng Chen, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/966,155

(22) Filed: Dec. 11, 2015

(65) Prior Publication Data

US 2016/0181743 A1 Jun. 23, 2016

(30) Foreign Application Priority Data

Dec. 19, 2014 (CN) ..... 2014 1 0792466

(51) Int. Cl.

| | |
|---|---|
| ***H01R 24/60*** | (2011.01) |
| ***H01R 13/52*** | (2006.01) |
| ***H01R 12/72*** | (2011.01) |
| *H01R 107/00* | (2006.01) |

(52) U.S. Cl.

CPC ..... *H01R 24/60* (2013.01); *H01R 12/724* (2013.01); *H01R 13/5202* (2013.01); *H01R 2107/00* (2013.01)

(58) Field of Classification Search

CPC ..... H01R 13/65932; H01R 13/6587; H01R 23/7073; H01R 23/6873; H01R 24/60

USPC ..... 439/607.4, 218, 108, 660

See application file for complete search history.

(56) References Cited

U.S. PATENT DOCUMENTS

| | | | | |
|---|---|---|---|---|
| 7,850,465 | B1 * | 12/2010 | Wan | H01R 12/712 439/607.4 |
| 7,918,688 | B2 * | 4/2011 | Lin | H01R 12/58 439/607.01 |
| 8,393,912 | B2 * | 3/2013 | Ko | H01R 13/641 439/345 |
| 8,535,087 | B1 * | 9/2013 | McKee | H01R 13/7031 439/489 |
| 8,974,249 | B2 * | 3/2015 | Zhang | H01R 12/724 439/607.4 |
| 9,065,219 | B2 * | 6/2015 | Naito | H01R 13/7033 |
| 9,124,059 | B2 * | 9/2015 | Dong | H01R 43/20 |
| 2009/0227147 | A1 * | 9/2009 | Momose | H05K 1/0216 439/638 |
| 2010/0203768 | A1 * | 8/2010 | Kondo | H01R 13/6474 439/676 |
| 2010/0267261 | A1 * | 10/2010 | Lin | H01R 13/6461 439/218 |
| 2012/0252279 | A1 * | 10/2012 | Lee | G06F 1/3206 439/660 |
| 2013/0225010 | A1 * | 8/2013 | Naito | H01R 24/60 439/676 |
| 2014/0024257 | A1 * | 1/2014 | Castillo | H01R 13/6585 439/607.05 |
| 2014/0273653 | A1 * | 9/2014 | Little | H01R 13/641 439/660 |

* cited by examiner

*Primary Examiner* — Tulsidas C Patel
*Assistant Examiner* — Marcus Harcum
(74) *Attorney, Agent, or Firm* — Muncy, Geissler, Olds & Lowe, P.C.

(57) ABSTRACT

An electrical receptacle connector includes an insulated housing, a plurality of upper-row receptacle terminals, and a plurality of lower-row receptacle terminals. The insulated housing includes a base portion. Each of the upper-row receptacle terminals includes a tail portion protruded from the base portion. Each of the lower-row receptacle terminals includes a tail portion protruded from the base portion. The tail portions of the upper-row receptacle terminals and the tail portions of the lower-row receptacle terminals are protruded from the base portion, aligned into a line, and spaced from each other.

10 Claims, 8 Drawing Sheets

ELECTRICAL RECEPTACLE CONNECTOR

CROSS-REFERENCES TO RELATED APPLICATIONS

This non-provisional application claims priority under 35 U.S.C. §119(a) on Patent Application No. 201410792466.X filed in China, P.R.C. on Dec. 19, 2014, the entire contents of which are hereby incorporated by reference.

FIELD OF THE INVENTION

The instant disclosure relates to an electrical connector, and more particular to an electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing.

Specifically, an existing USB type-C electrical receptacle connector includes an insulated housing, a plurality of first terminals, a plurality of second terminals, and a hollowed shell. The insulated housing includes a base portion and a tongue portion extended from one side of the base portion. The first terminals are held in the base portion and the tongue portion. The front of each of the first terminals is disposed at an upper surface of the tongue portion, and the rear of each of the first terminals is protruded from the base portion for connecting with a circuit board. The second terminals are held in the base portion and the tongue portion. The front of each of the second terminals is disposed at a lower surface of the tongue portion, and the rear of each of the second terminals is protruded from the base portion for connecting with the circuit board. However, after the rear of the first terminals (i.e., the tail portions of the first terminals) and the rear of the second terminals (i.e., the tail portions of the second terminals) are protruded from the base portion, the tail portions are aligned into several rows. When the tail portions are soldered with a circuit board, the inner tail portions are shielded by the outer tail portions, so that the operator cannot check if the inner tail portions are firmly soldered with the circuit board in a convenient manner.

SUMMARY OF THE INVENTION

Consequently, how to improve the existing connector becomes an issue.

In view of this, an exemplary embodiment of the instant disclosure provides an electrical receptacle connector. The tail portions of the receptacle are aligned into a line, so that an operator can check if the tail portions of the receptacle terminals of the connector are firmly soldered with a circuit board. Therefore, the problems met by the existing connector can be solved.

An embodiment of the electrical receptacle connector is adapted for transmitting USB 2.0 signals. The electrical receptacle connector comprises a metallic shell, an insulated housing, a plurality of upper-row receptacle terminals, and a plurality of lower-row receptacle terminals. The metallic shell defines a receiving cavity. The insulated housing is received in the receiving cavity. The insulated housing comprises a base portion and a tongue portion extended from one side of the base portion. The tongue portion has an upper surface and a lower surface. The upper-row receptacle terminals comprise a pair of USB 2.0 signal terminals, a power terminal, a ground terminal, and a detecting terminal. Each of the upper-row receptacle terminals comprises a flat contact portion, a body portion, and a tail portion. The body portions of the upper-row receptacle terminals are held in the base portion and disposed at the upper surface of the tongue portion. For the upper-row receptacle terminals, each of the flat contact portions is extended from one of two ends of the corresponding body portion and disposed at the upper surface of the tongue portion, and each of the tail portions is extended from the other end of the corresponding body portion and protruded from the base portion. The lower-row receptacle terminals comprise a pair of USB 2.0 signal terminals, a power terminal, a ground terminal, and a detecting terminal. Each of the lower-row receptacle terminals comprises a flat contact portion, a body portion, and a tail portion. The body portions of the lower-row receptacle terminals are held in the base portion and disposed at the lower surface of the tongue portion. For the lower-row receptacle terminals, each of the flat contact portions is extended from one of two ends of the corresponding body portion and disposed at the lower surface of the tongue portion, and each of the tail portions is extended from the other end of the corresponding body portion and protruded from the base portion. The tail portions of the upper-row receptacle terminals and the tail portions of the lower-row receptacle terminals are protruded from the base portion, aligned into a line, and spaced from each other.

Based on the above, the electrical receptacle connector is a reduction of a USB 3.0 Type-C connector in which the high-speed signal transmitting terminals are removed, so that instead of twelve upper-row receptacle terminals and twelve lower-row receptacle terminals, five upper-row receptacle terminals and five lower-row receptacle terminals are held in the insulated housing for transmitting USB 2.0 signals. As compared with an existing USB 2.0 electrical receptacle connector whose contact portions are aligned into a single row, the electrical receptacle connector of one embodiment provides flat contact portions respectively aligned in the upper-row and the lower-row. Therefore, an electrical plug connector can be mated with the electrical receptacle connector in either of two intuitive orientations for transmitting USB 2.0 signals. In addition, the tail portions of the upper-row receptacle terminals and the tail portions of the lower-row receptacle terminals are aligned into a same line for connecting with a circuit board. Hence, after the receptacle terminals are soldered with the circuit board, an operator can check if the tail portions are firmly soldered with the contacts of the circuit board in a convenient way. Moreover, the tail portions may be formed as SMT legs or through-hole legs, so that the length of the receptacle terminals can be reduced, and in an electronic device assembled with the electrical receptacle connector, the space occupied by the electrical receptacle connector can be reduced. Furthermore, by removing the high-speed signal transmitting terminals from the tongue portion, the structural strength of the insulated housing can be improved.

Furthermore, the upper-row receptacle terminals and the lower-row receptacle terminals are arranged upside down, and the pin-assignment of the flat contact portions of the upper-row receptacle terminals is left-right reversal with respect to that of the flat contact portions of the lower-row receptacle terminals. Accordingly, the electrical receptacle connector can have a 180 degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the upper-row receptacle terminals are in contact with upper-row plug terminals of the electrical plug connector. Conversely, when the electrical plug connector is inserted into the electrical receptacle connector with a second orientation, the flat contact portions of the lower-row receptacle terminals are in contact with the upper-row plug terminals of the electrical plug connector. Note that, the inserting orientation of the electrical plug connector is not limited by the electrical receptacle connector.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
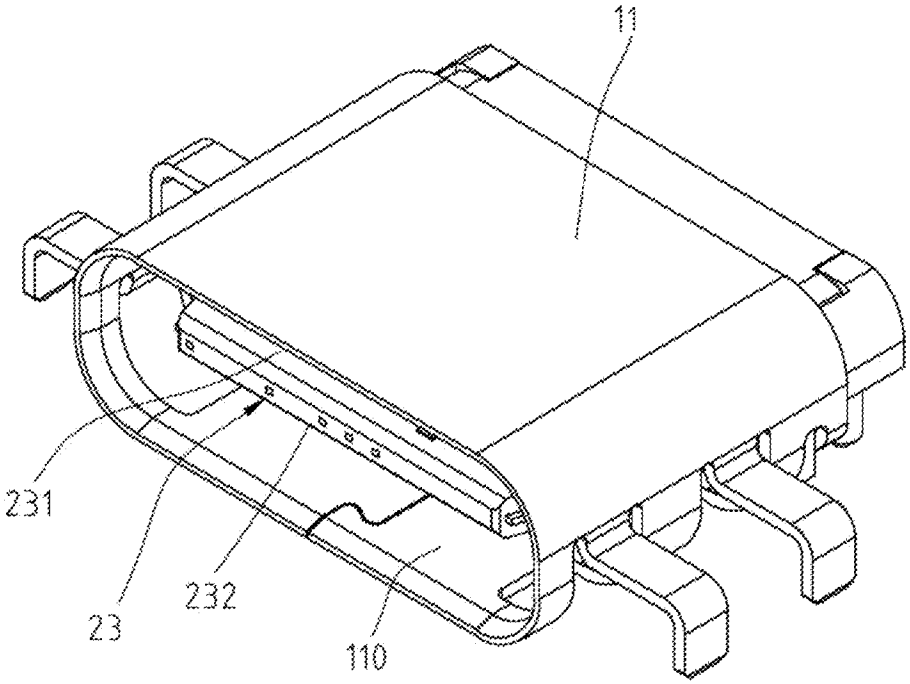
FIG. 1 illustrates a perspective view of an electrical receptacle connector according to an exemplary embodiment of the instant disclosure.
Figure 2:
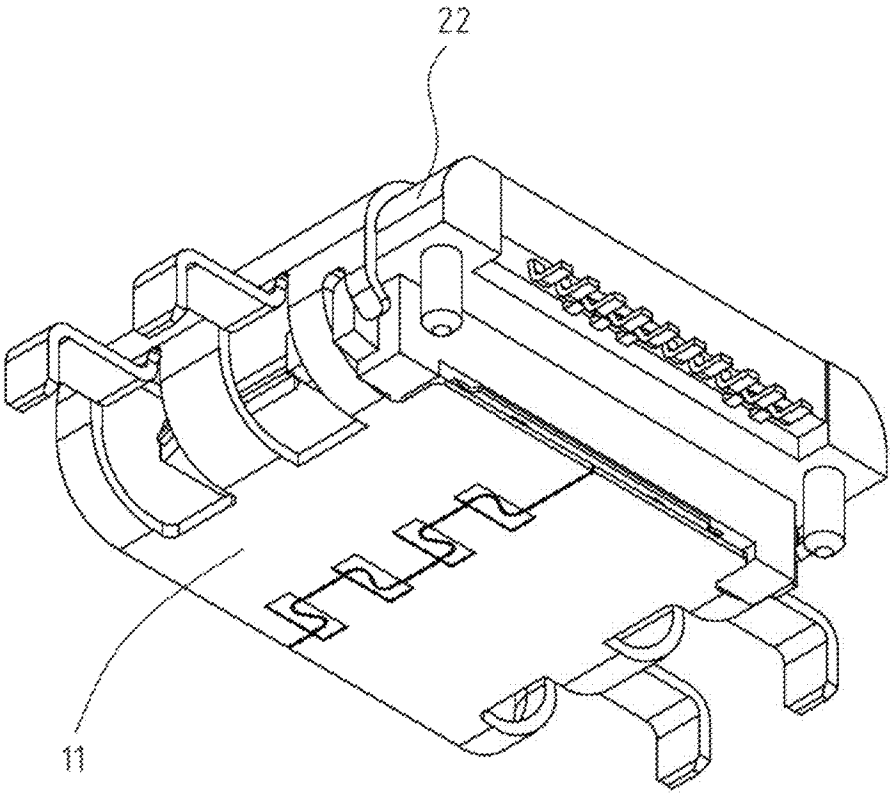
FIG. 2 illustrates a perspective view from the back of the electrical receptacle connector.
Figure 3:
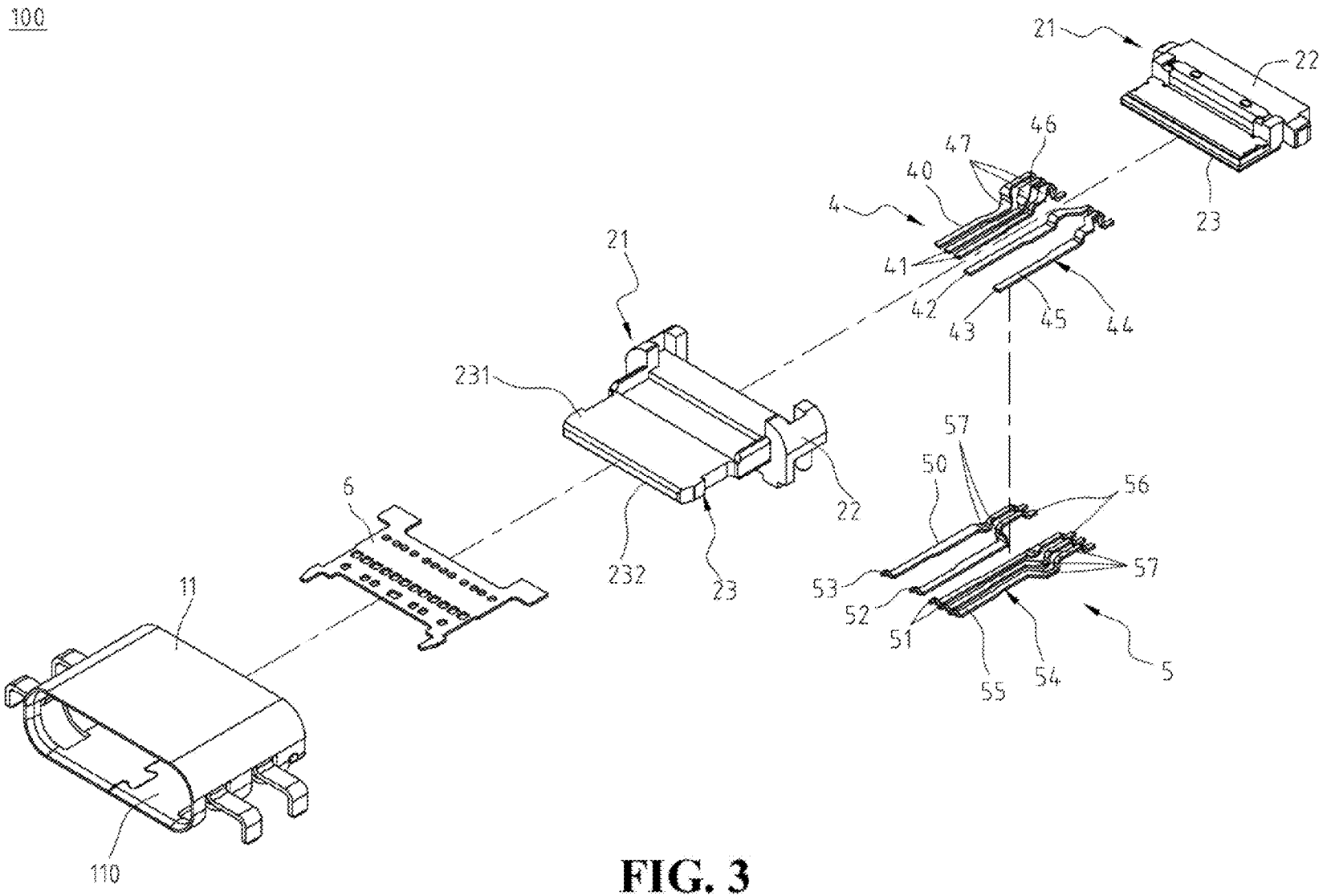
FIG. 3 illustrates an exploded view of the electrical receptacle connector.

Please refer to FIG. 1 to FIG. 3, which illustrate an electrical receptacle connector 100 of a first embodiment according to the instant disclosure. FIG. 1 illustrates a perspective view of the electrical receptacle connector 100. FIG. 2 illustrates a perspective view from the back of the electrical receptacle connector 100. FIG. 3 illustrates an exploded view of the electrical receptacle connector 100. In this embodiment, the electrical receptacle connector 100 can provide a reversible or dual orientation USB Type-C connector interface and pin assignments, i.e., a USB Type-C receptacle connector. The connector can be utilized in mobile devices, laptop computers, digital cameras, or other electronic devices. In this embodiment, the electrical receptacle connector 100 comprises a metallic shell 11, an insulated housing 21, a plurality of upper-row receptacle terminals 4, and a plurality of lower-row receptacle terminals 5. In addition, the electrical receptacle connector 100 further comprises a grounding plate 6 disposed in the insulated housing 21 and located between the upper-row receptacle terminals 4 and the lower-row receptacle terminals 5.

Figure 4:
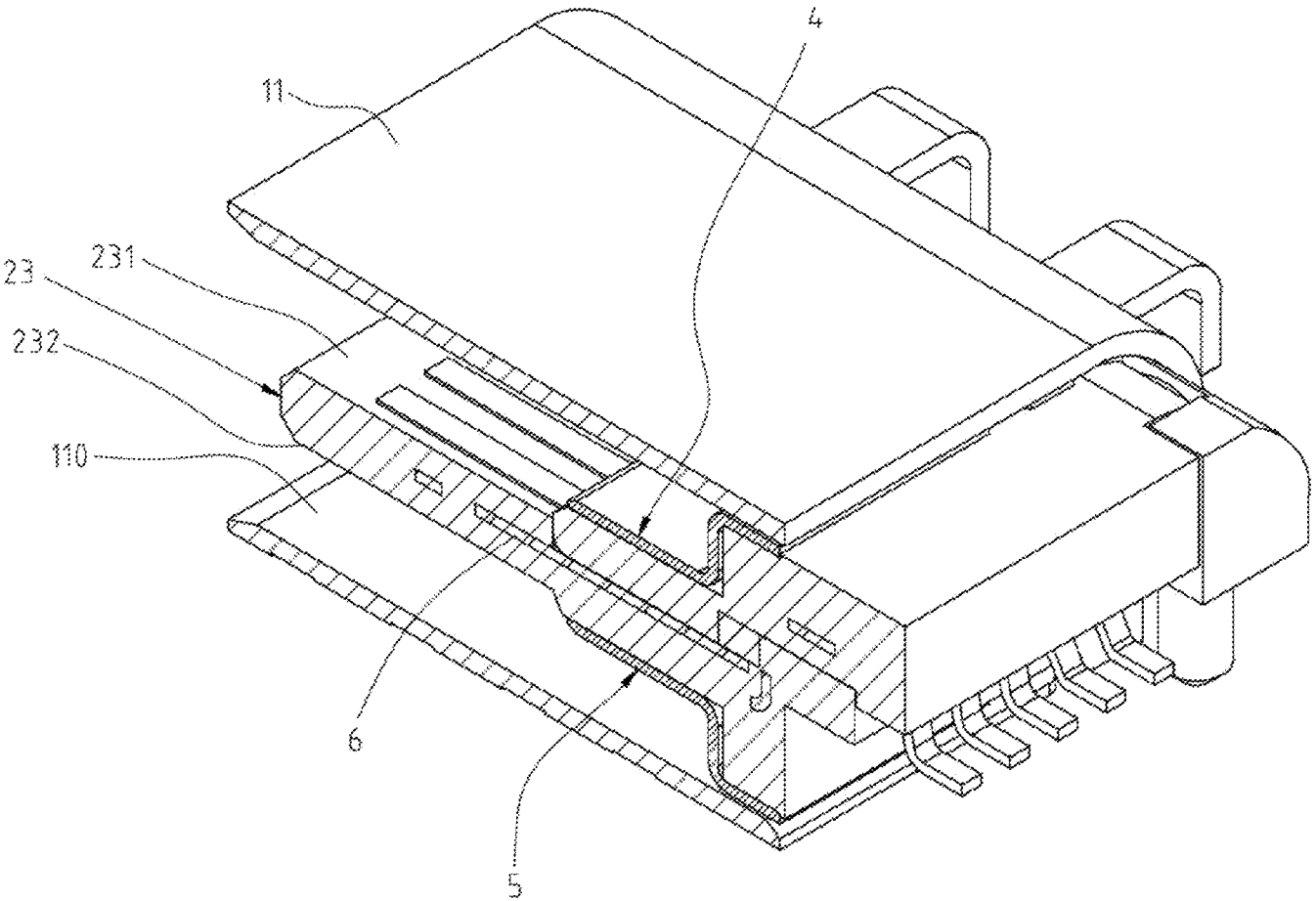
FIG. 4 illustrates a perspective sectional view of the electrical receptacle connector.

Please refer to FIGS. 3 to 4. The metallic shell 11 is a hollowed shell. The metallic shell 11 defines a receiving cavity 110 therein. In this embodiment, the metallic shell 11 may be formed by bending a unitary member. An insertion window, rectangular-shaped or oblong-shaped, is formed at one side of the metallic shell 11. Moreover, the insertion window communicates with the receptacle cavity 110.

Please refer to FIGS. 2 to 3. The insulated housing 21 is received in the metallic shell 11, and the insulated housing 21 is enclosed by the metallic shell 11. The insulated housing 21 comprises a base portion 22 and a tongue portion 23. The tongue portion 23 is extended from one side of the base portion 22. In this embodiment, the insulated housing 21 is formed by combining a first member with a second member. In other words, the assembly of the first member and the second member defines the base portion 22 and the tongue portion 23. In addition, the first member forms parts of the tongue portion 23 and the upper portion of the base portion 22, and the second member forms rest parts of the tongue portion 23 and the lower portion of the base portion 22, but embodiments are not limited thereto. In some embodiments, the base portion 22 and the tongue portion 23 may be formed integrally as a whole by injection molded or the like. In addition, the tongue portion 23 has an upper surface 231 and a lower surface 232 opposite to the upper surface 231.

Please refer to FIG. 2 and FIG. 4. The upper-row receptacle terminals 4 are held in the base portion 22 and the tongue portion 23. The upper-row receptacle terminals 4 may be assembled with the base portion 22 and the tongue portion 23 by means of insert-molding or the like, so that the upper-row receptacle terminals 4 are aligned in the same plane and can be soldered with a circuit board conveniently. Each of the upper-row receptacle terminals 4 comprises a flat contact portion 45, a body portion 44, and a tail portion 46. The body portions 44 are held in the base portion 22 and disposed at the upper surface 231 of the tongue portion 23. Each of the flat contact portions 45 is extended from one of two ends of the corresponding body portion 44 and disposed at the upper surface 231 of the tongue portion 23, and each of the tail portions 46 is extended from the other end of the corresponding body portion 44 and protruded from the base portion 22. The upper-row receptacle terminals 4 are disposed at the upper surface 231 of the tongue portion 23 and provided for transmitting first signals (i.e., USB 2.0 signals). The tail portions 46 are extended out of the bottom surface of the base portion 22. In this embodiment, each of the upper-row receptacle terminals 4 comprises a bent portion 47 extended from the rear of the body portion 44 toward the tail portion 46. The position of each of the tail portions 46 can be changed by its corresponding bent portion 47, so that each of the tail portions 46 and the corresponding body portion 44 are aligned at different horizontal lines. Accordingly, the tail portions 46 can be linearly aligned with each other along the same horizontal line. The bent portions 47 can be provided to adjust the intervals between the tail portions or can be mated with bent portion 57. Therefore, the intervals between the tail portions 46 of the upper-row receptacle terminals 4, the intervals between the tail portions 56 of the lower-row receptacle terminals 5, or the interval between the tail portion 46 of each of the upper-row receptacle terminals 4 and the tail portion 56 of the corresponding lower-row receptacle terminal 5 can be constant or different.

Please refer to FIG. 2 and FIG. 4. The lower-row receptacle terminals 5 are held in the base portion 22 and the tongue portion 23. The lower-row receptacle terminals 5 may be assembled with the base portion 22 and the tongue portion 23 by means of insert-molding or the like, so that the lower-row receptacle terminals 5 are aligned in the same plane and can be soldered with a circuit board conveniently. The lower-row receptacle terminals 5 are spacedly aligned below the upper-row receptacle terminals 4. Each of the lower-row receptacle terminals 5 comprises a flat contact portion 55, a body portion 54, and a tail portion 56. The body portions 54 are held in the base portion 22 and disposed at the lower surface 232 of the tongue portion 23. Each of the flat contact portions 55 is extended from one of two ends of the corresponding body portion 54 and disposed at the lower surface 232 of the tongue portion 23, and each of the tail portions 56 is extended from the other end of the corresponding body portion 54 and protruded from the base portion 22. The lower-row receptacle terminals 5 are disposed at the lower surface 232 of the tongue portion 13 and provided for transmitting second signals (i.e., USB 2.0 signals). The tail portions 56 are extended out of the bottom of the base portion 22. In this embodiment, each of the lower-row receptacle terminals 5 comprises a bent portion 57 extended from the rear of the body portion 54 toward the tail portion 56. The position of each of the tail portions 56 can be changed by its corresponding bent portion 57, so that each of the tail portions 56 and the corresponding body portion 54 are aligned at different horizontal lines. Accordingly, the tail portions 56 can be linearly aligned with each other along the same horizontal line. The bent portions 57 can be provided to adjust the intervals between the tail portions or can be mated with bent portion 47. Therefore, the intervals between the tail portions 46 of the upper-row receptacle terminals 4, the intervals between the tail portions 56 of the lower-row receptacle terminals 5, or the interval between the tail portion 46 of each of the upper-row receptacle terminals 4 and the tail portion 56 of the corresponding lower-row receptacle terminal 5 can be constant or different.

Figure 5:
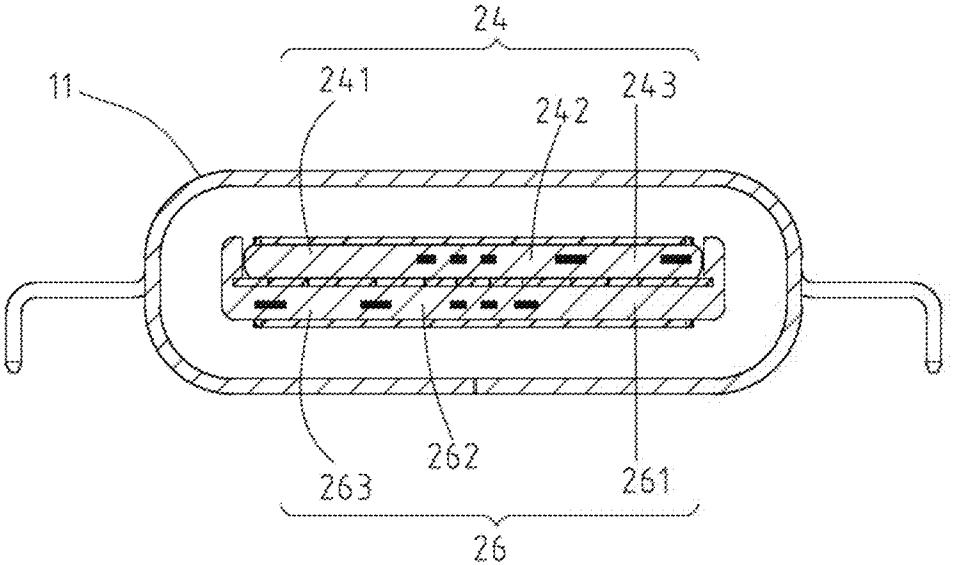
FIG. 5 illustrates a front sectional view of the electrical receptacle connector.
Figure 6:
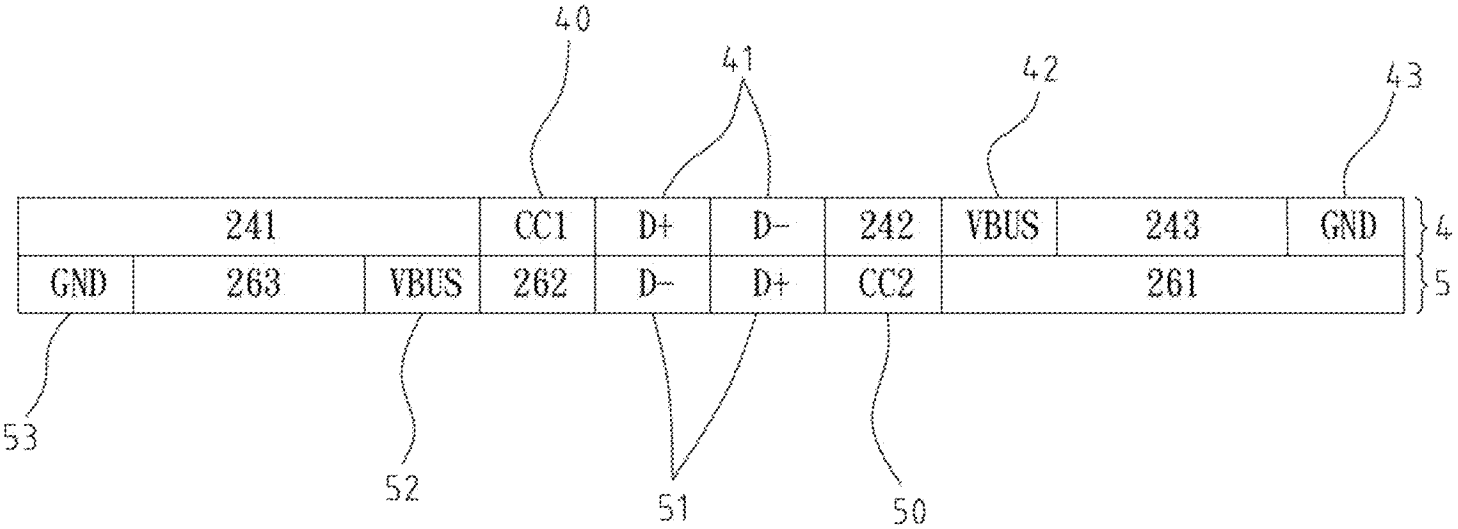
FIG. 6 illustrates a schematic configuration diagram of the receptacle terminals of the electrical receptacle connector shown in FIG. 5.

Please refer to FIG. 2, FIG. 5, and FIG. 6. In this embodiment, the upper-row receptacle terminals 4 comprise a plurality of signal terminals, a power terminal 42, a ground terminal 43, and a detecting terminal 40. The detecting terminal 40 is provided to configure the orientation of an electrical plug connector when the electrical plug connector is mated with the electrical receptacle connector 100. As shown in FIG. 5 and FIG. 6, the upper-row receptacle terminals 4 comprise, from left to right, a detecting terminal 40 (CC1), a pair of USB 2.0 signal terminals 41 (i.e., a differential pairs (D+−)), a power terminal 42 (Power/VBUS), and a rightmost ground terminal 43 (Gnd). In this embodiment, the number of the upper-row receptacle terminals 4 is five which meets the criteria in transmitting USB 2.0 signals.

Please refer to FIGS. 4-6. It is understood that, in this embodiment, the number of the upper-row receptacle terminals 4 of the electrical receptacle connector 100 is reduced as compared to a typical USB 3.0 Type-C connector, particularly the high-speed signal transmitting terminals disposed at the upper surface 231 of the tongue portion 23 of the insulated housing 21 are omitted. In other words, the electrical receptacle connector 100 comprises a plurality of upper-row reserved portions 24. The upper-row reserved portions 24 are free of terminals, i.e., the upper-row reserved portions 24 are reserved spaces. The upper-row reserved portions 24 comprise a first upper-row reserved portion 241, a second upper-row reserved portion 242, and a third upper-row reserved portion 243. As shown in FIG. 5 and FIG. 6, the first upper-row reserved portion 241 is formed at the left side of the detecting terminal 40 (CC1). In a typical USB 3.0 Type-C connector's configuration, a ground terminal 43 (Gnd), a pair of differential pairs (TX1+−), and a power terminal 42 (Power/VBUS) are sequentially, from left to right, assembled in the first upper-row reserved portion 241 for high speed signal transmission. The second upper-row reserved portion 242 is formed between the pair of USB 2.0 signal terminals 41 and the power terminal 42 (Power/VBUS). In a USB 3.0 Type-C connector's configuration, a retain terminal (RFU) is assembled in the second upper-row reserved portion 242. The third upper-row reserved portion 243 is formed between the power terminal 42 (Power/VBUS) and the ground terminal 43 (Gnd). In a USB 3.0 Type-C connector's configuration, a pair of differential pairs (RX2+−) is assembled in the third upper-row reserved portion 243. In a typical USB 3.0 Type-C connector's configuration, the electrical receptacle connector 100 has twelve upper-row receptacle terminals 4 and adapted to transmit USB 3.0 signals.

Please refer to FIG. 2, FIG. 5, and FIG. 6. In this embodiment, the lower-row receptacle terminals 5 comprise a plurality of signal terminals, a power terminal 52, a ground terminal 53, and a detecting terminal 50. The detecting terminal 50 is provided to configure the orientation of an electrical plug connector when the electrical plug connector is mated with the electrical receptacle connector 100. As shown in FIG. 5 and FIG. 6, the lower-row receptacle terminals 5 comprise, from right to left in order, a detecting terminal 50 (CC2), a pair of USB 2.0 signal terminals 51 (i.e., a differential pairs (D−+)), a power terminal 52 (Power/VBUS), and a leftmost ground terminal 53 (Gnd). In this embodiment, the number of the lower-row receptacle terminals 5 is five which meets the criteria in transmitting USB 2.0 signals.

Please refer to FIGS. 4-6. It is understood that, in this embodiment, the number of the lower-row receptacle terminals 5 of the electrical receptacle connector 100 is reduced as compared to a typical USB 3.0 Type-C connector, particularly the high-speed signal transmitting terminals disposed at the lower surface 232 of the tongue portion 23 of the insulated housing 21 are omitted. In other words, the electrical receptacle connector 100 comprises a plurality of lower-row reserved portions 26. The lower-row reserved portions 26 are free of terminals, i.e., the lower-row reserved portions 26 are reserved spaces. The lower-row reserved portions 26 comprise a first lower-row reserved portion 261, a second lower-row reserved portion 262, and a third lower-row reserved portion 263. As shown in FIG. 5 and FIG. 6, the first lower-row reserved portion 261 is formed at the right side of the detecting terminal 50 (CC2). In a typical USB 3.0 Type-C connector's configuration, a ground terminal 53 (Gnd), a pair of differential pairs (TX2+−), and a power terminal 52 (Power/VBUS) are sequentially, from right to left, assembled in the first lower-row reserved portion 261 for high speed signal transmission. The second lower-row reserved portion 262 is formed between the pair of USB 2.0 signal terminals 51 and the power terminal 52 (Power/VBUS). In a USB 3.0 Type-C connector's configuration, a retain terminal (RFU) is assembled in the second lower-row reserved portion 262. The third lower-row reserved portion 263 is formed between the power terminal 52 (Power/VBUS) and the ground terminal 53 (Gnd). In a USB 3.0 Type-C connector's configuration, a pair of differential pairs (RX1+−) is assembled in the third lower-row reserved portion 263. In a typical USB 3.0 Type-C connector's configuration, the electrical receptacle connector 100 has twelve lower-row receptacle terminals 5 and adapted to transmit USB 3.0 signals.

Figure 7:
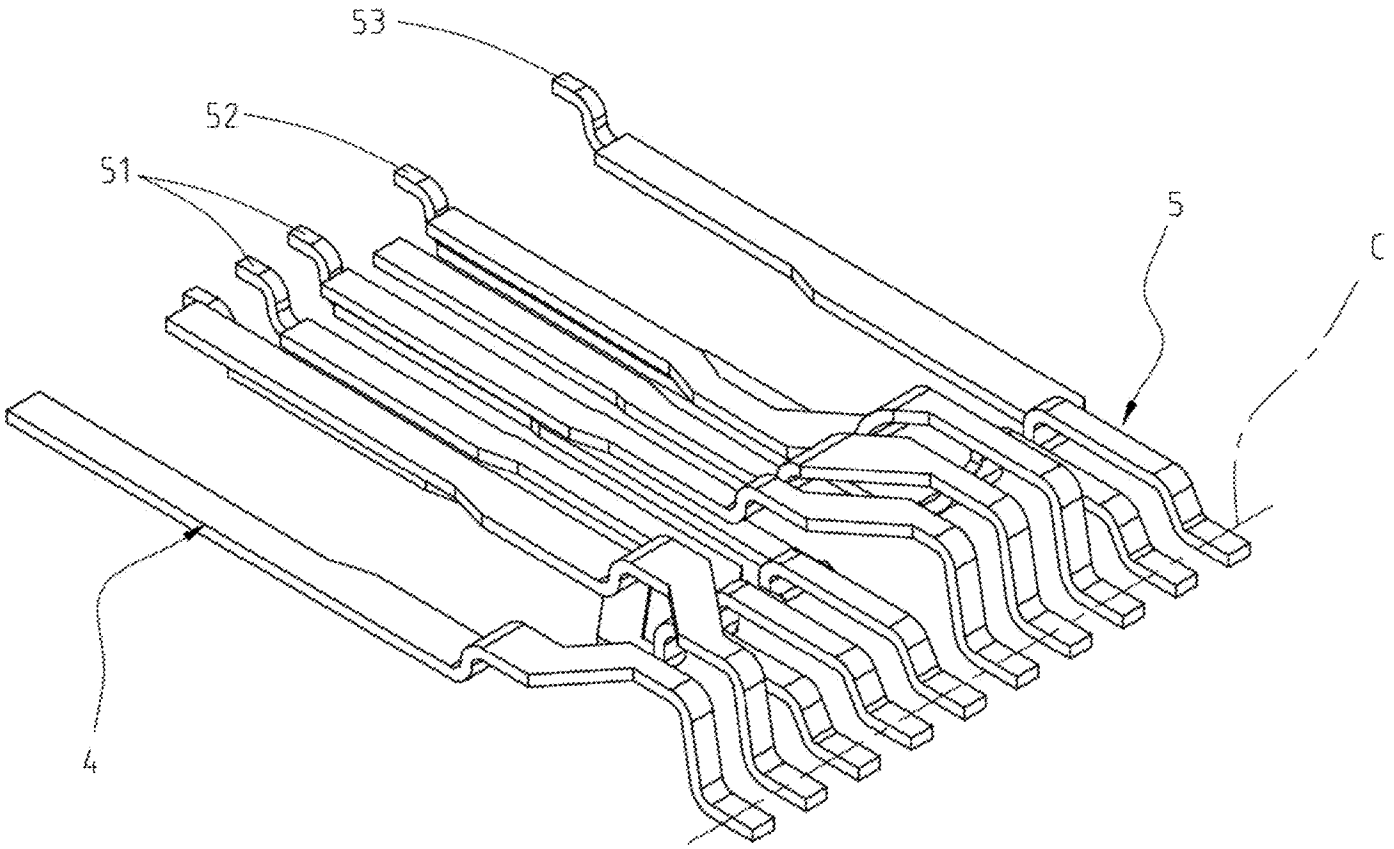
FIG. 7 illustrates a perspective view (1) showing the upper-row receptacle terminals and the lower-row receptacle terminals of the electrical receptacle connector.
Figure 8:
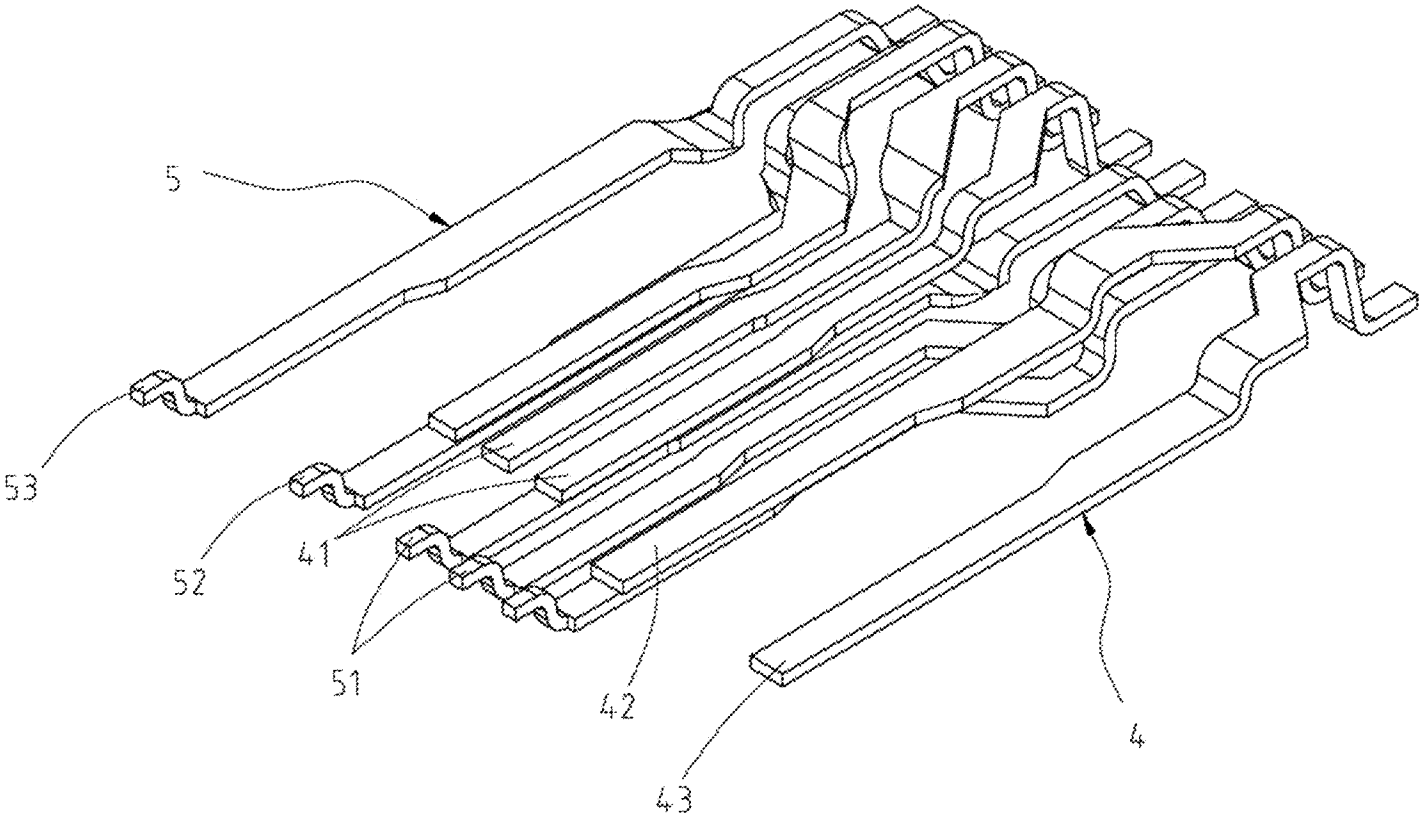
FIG. 8 illustrates a perspective view (2) showing the upper-row receptacle terminals and the lower-row receptacle terminals of the electrical receptacle connector.

Please refer to FIGS. 6 to 8. In other words, in the foregoing embodiments, the number of the receptacle terminals 4, 5 of the electrical receptacle connector 100 is reduced as compared to a typical USB 3.0 Type-C connector, particularly, the upper-row receptacle terminals 4 or the lower-row receptacle terminals 5 are devoid of some terminals, so that the electrical receptacle connector 100 is adapted to transmit USB 2.0 signals. That is, in accordance with the USB 2.0 signal transmission, the upper-row receptacle terminals 4 are devoid of the first differential pairs (TX1+−) and the third differential pairs (RX2+−), while the detecting terminal 40 (CC1), the second differential pairs 41 (D+−), the power terminal 42 (Power/VBUS), and the ground terminal 43 (Gnd) are retained for transmitting USB 2.0 signals. Similarly, in accordance with the USB 2.0 signal transmission, the lower-row receptacle terminals 5 are devoid of the first differential pairs (TX2+−) and the third differential pairs (RX1+−), while the detecting terminal 50 (CC2), the second differential pairs 51 (D+−), the power terminal 52 (Power/VBUS), and the ground terminal 53 (Gnd) are retained for transmitting USB 2.0 signals.

Please refer to FIG. 3, FIG. 6, and FIG. 7. In this embodiment, the tail portions 46 and the tail portions 56 are protruded from the base portion, aligned into the same line (aligned into a single line), and spaced from each other. In other words, the tail portions 46 and the tail portions 56 are aligned along the same line C. From the back of the electrical receptacle connector 100, i.e., as shown in FIG. 7, the receptacle terminals 4, 5 are aligned, from left to right in order, by a configuration of, a tail portion 46 of the ground terminal 43, a tail portion 46 of the power terminal 42, a tail portion 56 of the detecting terminal 50 (CC2), tail portions 56 of the pair of USB 2.0 signal terminals 51, tail portions 46 of the pair of USB 2.0 signal terminals 41, a tail portion 46 of the detecting terminal 40 (CC1), a tail portion 56 of the power terminal 52, and a tail portion 56 of the ground terminal 53.

Please refer to FIG. 2 and FIG. 7. In this embodiment, the tail portions 46 may be bent horizontally to form flat legs, named SMT (surface mounted technology) legs, which can be mounted or soldered on the surface of a printed circuit board (PCB) by using surface mount technology. On the other hand, the tail portions 46 may be extended downwardly to form vertical legs, named through-hole legs, that are inserted into holes drilled in a printed circuit board (PCB) by using through-hole technology. Similarly, the tail portions 56 may be bent horizontally to form flat legs, named SMT legs, which can be mounted or soldered on the surface of a printed circuit board (PCB) by using surface mount technology. Alternatively, the tail portions 56 may be extended downwardly to form vertical legs, named through-hole legs, that are inserted into holes drilled in a printed circuit board (PCB) by using through-hole technology. Accordingly, the tail portions 46 and the tail portions 56 in SMT leg or through-hole leg configurations are aligned into a line, so that the length of the receptacle terminals 4, 5 can be reduced, and in an electronic device assembled with the electrical receptacle connector 100, the space occupied by the electrical receptacle connector 100 can be reduced.

Please refer to FIGS. 4 to 6. In this embodiment, the upper-row receptacle terminals 4 and the lower-row receptacle terminals 5 are respectively disposed at the upper surface 231 and the lower surface 232 of the tongue portion 23. In this embodiment, as shown in FIG. 5 and FIG. 6, the position of the upper-row receptacle terminals 4 corresponds to the position of the lower-row receptacle terminals 5. Additionally, pin-assignments of the upper-row receptacle terminals 4 and the lower-row receptacle terminals 5 are point-symmetrical with a central point of the receptacle cavity 110 as the symmetrical center. In other words, pin-assignments of the upper-row receptacle terminals 4 and the lower-row receptacle terminals 5 have 180 degree symmetrical design with respect to the central point of the receptacle cavity 110 as the symmetrical center. The dual or double orientation design enables an electrical plug connector to be inserted into the electrical receptacle connector 100 in either of two intuitive orientations, i.e., in either upside-up or upside-down directions.

Here, point-symmetry means that after the upper-row receptacle terminals 4 (or the lower-row receptacle terminals 5), are rotated by 180 degrees with the symmetrical center as the rotating center, the upper-row receptacle terminals 4 and the lower-row receptacle terminals 5 are overlapped. That is, the rotated upper-row receptacle terminals 4 are arranged at the position of the original lower-row receptacle terminals 5, and the rotated lower-row receptacle terminals 5 are arranged at the position of the original upper-row receptacle terminals 4. In other words, the upper-row receptacle terminals 4 and the lower-row receptacle terminals 5 are arranged upside down, and the pin assignments of the flat contact portions 45 are left-right reversal with respect to that of the flat contact portions 55. An electrical plug connector is inserted into the electrical receptacle connector 100 with a first orientation where the upper surface 231 is facing up, for transmitting first signals. Conversely, the electrical plug connector is inserted into the electrical receptacle connector 100 with a second orientation where the upper surface 231 is facing down, for transmitting second signals. Furthermore, the specification for transmitting the first signals is conformed to the specification for transmitting the second signals. Note that, the inserting orientation of the electrical plug connector is not limited by the electrical receptacle connector 100 according embodiments of the instant disclosure.

Based on the above, the electrical receptacle connector is a reduction of a USB 3.0 Type-C connector in which the high-speed signal transmitting terminals are removed, so that instead of twelve upper-row receptacle terminals and twelve lower-row receptacle terminals, five upper-row receptacle terminals and five lower-row receptacle terminals are held in the insulated housing for transmitting USB 2.0 signals. As compared with an existing USB 2.0 electrical receptacle connector whose contact portions are aligned into a single row, the electrical receptacle connector of one embodiment provides flat contact portions respectively aligned in the upper-row and the lower-row. Therefore, an electrical plug connector can be mated with the electrical receptacle connector in either of two intuitive orientations for transmitting USB 2.0 signals. In addition, the tail portions of the upper-row receptacle terminals and the tail portions of the lower-row receptacle terminals are aligned into a same line for connecting with a circuit board. Hence, after the receptacle terminals are soldered with the circuit board, an operator can check if the tail portions are firmly soldered with the contacts of the circuit board in a convenient way. Moreover, the tail portions may be formed as SMT legs or through-hole legs, so that the length of the receptacle terminals can be reduced, and in an electronic device assembled with the electrical receptacle connector, the space occupied by the electrical receptacle connector can be reduced. Furthermore, by removing the high-speed signal transmitting terminals from the tongue portion, the structural strength of the insulated housing can be improved.

Furthermore, the upper-row receptacle terminals and the lower-row receptacle terminals are arranged upside down, and the pin-assignment of the flat contact portions of the upper-row receptacle terminals is left-right reversal with respect to that of the flat contact portions of the lower-row receptacle terminals. Accordingly, the electrical receptacle connector can have a 180 degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the upper-row receptacle terminals are in contact with upper-row plug terminals of the electrical plug connector. Conversely, when the electrical plug connector is inserted into the electrical receptacle connector with a second orientation, the flat contact portions of the lower-row receptacle terminals are in contact with the upper-row plug terminals of the electrical plug connector. Note that, the inserting orientation of the electrical plug connector is not limited by the electrical receptacle connector.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

a metallic shell defines a receiving cavity;

an insulated housing received in the receiving cavity, wherein the insulated housing comprises a base portion and a tongue portion extended from one side of the base portion, wherein the tongue portion has an upper surface and a lower surface opposite to the upper surface;

a plurality of upper-row receptacle terminals comprising a pair of USB 2.0 signal terminals, a power terminal, a ground terminal, and a detecting terminal, wherein each of the upper-row receptacle terminals comprises a flat contact portion, a body portion, and a tail portion, wherein the body portions are held in the base portion and disposed at the upper surface of the tongue portion, each of the flat contact portions is extended from one of two ends of the corresponding body portion and disposed at the upper surface of the tongue portion, and each of the tail portions is extended from the other end of the corresponding body portion and protruded from the base portion; and a plurality of lower-row receptacle terminals comprising a pair of USB 2.0 signal terminals, a power terminal, a ground terminal, and a detecting terminal, wherein each of the lower-row receptacle terminals comprises a flat contact portion, a body portion, and a tail portion, wherein the body portions are held in the base portion and disposed at the lower surface of the tongue portion, each of the flat contact portions is extended from one of two ends of the corresponding body portion and disposed at the lower surface of the tongue portion, and each of the tail portions is extended from the other end of the corresponding body portion and protruded from the base portion, and wherein the tail portions of the upper-row receptacle terminals and the tail portions of the lower-row receptacle terminals are protruded from the base portion, aligned into a line, and spaced from each other.

2. The electrical receptacle connector according to claim 1, wherein each of the upper-row receptacle terminals comprises a bent portion extended from the rear of the body portion toward the tail portion.

3. The electrical receptacle connector according to claim 1, wherein each of the lower-row receptacle terminals comprises a bent portion extended from the rear of the body portion toward the tail portion.

4. The electrical receptacle connector according to claim 1, wherein the tongue portion comprises a plurality of upper-row reserved portions aside the upper-row receptacle terminals.

5. The electrical receptacle connector according to claim 4, wherein the upper-row reserved portions comprise a first upper-row reserved portion formed at the left side of the detecting terminal, a second upper-row reserved portion formed between the pair of USB 2.0 signal terminals and the power terminal, and a third upper-row reserved portion formed between the power terminal and the ground terminal.

6. The electrical receptacle connector according to claim 1, wherein the tongue portion comprises a plurality of lower-row reserved portions aside the lower-row receptacle terminals.

7. The electrical receptacle connector according to claim 6, wherein the lower-row reserved portions comprise a first lower-row reserved portion formed at the right side of the detecting terminal, a second lower-row reserved portion formed between the pair of USB 2.0 signal terminals and the power terminal, and a third lower-row reserved portion formed between the power terminal and the ground terminal.

8. The electrical receptacle connector according to claim 1, further comprising a grounding plate disposed at the insulated housing and located between the upper-row receptacle terminals and the lower-row receptacle terminals.

9. The electrical receptacle connector according to claim 1, wherein the upper-row receptacle terminals and the lower-row receptacle terminals have 180 degree symmetrical design with respect to a central point of the receiving cavity as the symmetrical center.

10. The electrical receptacle connector according to claim 9, wherein the position of the upper-row receptacle terminals corresponds to the position of the lower-row receptacle terminals.

* * * * *